US011598505B2

(12) United States Patent
Igawa et al.

(10) Patent No.: US 11,598,505 B2
(45) Date of Patent: Mar. 7, 2023

(54) VEHICULAR LAMP FITTING

(71) Applicant: STANLEY ELECTRIC CO., LTD., Tokyo (JP)

(72) Inventors: Haruki Igawa, Tokyo (JP); Kohei Igarashi, Tokyo (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 17/689,537

(22) Filed: Mar. 8, 2022

(65) Prior Publication Data

US 2022/0290836 A1 Sep. 15, 2022

(30) Foreign Application Priority Data

Mar. 10, 2021 (JP) ..... JP2021-038085

(51) Int. Cl.

| | |
|---|---|
| ***F21S 43/245*** | (2018.01) |
| ***F21S 43/237*** | (2018.01) |
| ***F21Y 115/10*** | (2016.01) |
| ***F21S 43/14*** | (2018.01) |
| ***F21S 43/31*** | (2018.01) |

(52) U.S. Cl.

CPC ..... *F21S 43/245* (2018.01); *F21S 43/14* (2018.01); *F21S 43/237* (2018.01); *F21S 43/31* (2018.01); *F21Y 2115/10* (2016.08)

(58) Field of Classification Search

CPC ..... F21S 43/237; F21S 43/251; F21S 43/241

See application file for complete search history.

(56) References Cited

U.S. PATENT DOCUMENTS

| | | | | |
|---|---|---|---|---|
| 10,215,360 | B1 | 2/2019 | Grogan et al. | |
| 2018/0017227 | A1* | 1/2018 | Greene | G02B 6/001 |
| 2018/0299092 | A1* | 10/2018 | Orisich | G02B 6/001 |
| 2019/0063710 | A1* | 2/2019 | Zanma | F21S 43/27 |
| 2019/0283663 | A1* | 9/2019 | Ohgitani | B60Q 1/04 |

FOREIGN PATENT DOCUMENTS

JP 2020-017518 A 1/2020

* cited by examiner

*Primary Examiner* — Eric T Eide

(74) *Attorney, Agent, or Firm* — Kenealy Vaidya LLP

(57) ABSTRACT

A vehicular lamp fitting comprises: a decorative member; a first inner lens disposed on the front surface side of the decorative member; a light source disposed on the back surface side of the decorative member; a second inner lens disposed on the back surface side of the decorative member; the first inner lens includes a first light-entering surface, a first light-exiting surface, a first light guiding unit configured to guide light entering from the first light-entering surface, and a first reflection surface configured to reflect the light guided in the first light guiding unit to exit from the first light-exiting surface; the second inner lens includes a second light-entering surface arranged in a state facing the light source, a second light-exiting surface arranged in a state facing the first light-entering surface through a space, and a second light guiding unit.

7 Claims, 11 Drawing Sheets

VEHICULAR LAMP FITTING

INCORPORATION BY REFERENCE

This application is based upon and claims the benefit of priority from Japanese patent application No. 2021-038085, filed on Mar. 10, 2021, the disclosure of which is incorporated herein in its entirety by reference.

BACKGROUND

The present invention relates to a vehicular lamp fitting, and more particularly to a vehicular lamp fitting capable of allowing light from a light source to enter a light guiding unit arranged on the front surface side of a decorative member (for example, a reflector) even when the light source is arranged on the back surface side of the decorative member (for example, a reflector) in a state covered with the decorative member.

There is known a vehicular lamp fitting in which a light source is arranged near one end side (light-entering surface) of a rod-shaped light guiding unit extending in the longitudinal direction, and light from the light source is input from one end side (light-entering surface) of the light guiding unit (for example, see Japanese Unexamined Patent Application Publication No. 2020-017518).

On the other hand, the present inventors have considered arranging the light source in a state covered with the decorative member (for example, a reflector) on the back surface side of the decorative member, and allowing light from the light source to enter the light guiding unit arranged on the front surface side of the decorative member (for example, a reflector).

SUMMARY

In Patent Document 1, when the light source is arranged on the back surface side of the decorative member (for example, a reflector) in a state covered with the decorative member, a distance between the light source and one end side (light-entering surface) of the light guiding unit is separated. Therefore, light from the light source cannot enter the light guiding unit unless the light guiding unit disposed on the surface side of the decorative member (for example, a reflector) is extended to the vicinity of the light source.

However, it is difficult to form the light guiding unit extended to the vicinity of the light source (this cannot be achieved in terms of a mold). Therefore, when the light source is arranged on the back surface side of the decorative member (for example, a reflector) in a state covered with the decorative member, there is a problem that light from the light source cannot enter the light guiding unit arranged on the front surface side of the decorative member (for example, a reflector).

The present disclosure has been made in view of such an issue and is directed to providing a vehicular lamp fitting capable of allowing light from a light source to enter a light guiding unit arranged on the front surface side of a decorative member (for example, a reflector) even when the light source is arranged on the back surface side of the decorative member (for example, a reflector) in a state covered with the decorative member.

A vehicular lamp fitting according to the present invention comprises a decorative member; a first inner lens disposed on the front surface side of the decorative member; a light source disposed on the back surface side of the decorative member; a second inner lens disposed on the back surface side of the decorative member; the first inner lens includes a first light-entering surface, a first light-exiting surface, a first light guiding unit configured to guide light entering from the first light-entering surface, and a first reflection surface configured to reflect the light guided in the first light guiding unit to exit from the first light-exiting surface; the second inner lens includes a second light-entering surface arranged in a state facing the light source, a second light-exiting surface arranged in a state facing the first light-entering surface through a space, and a second light guiding unit configured to guide light from the light source, which has entered from the second light-entering surface, to the second light-exiting surface.

With such a configuration, even when the light source is disposed on the back surface side of the decorative member (for example, a reflector) in a state covered with the decorative member, light from the light source can enter the light guiding unit disposed on the front surface side of the decorative member (for example, a reflector).

This is because of the following reasons. The first reason is that the first inner lens and the second inner lens are separated from each other. The second reason is that the first light-entering surface of the first light guiding unit of the first inner lens and the second light-exiting surface of the second light guiding unit of the second inner lens are arranged in a state of facing each other across a space.

Moreover, in the vehicular lamp fitting described above, the decorative member may be formed with a through hole passing through its front surface and its back surface, the first light-entering surface side of the first light guiding unit may be inserted into the through hole, the first light-entering surface of the first inner lens and the second light-exiting surface of the second inner lens may be opposed to each other through a space on the back surface side of the decorative member so that light exiting from the second light-exiting surface enters from the first light-entering surface.

Moreover, in the vehicular lamp fitting described above, the first inner lens may be attached to the decorative member, the second inner lens may be attached to the housing, wherein the vehicular lamp fitting further may comprise positioning structure configured to position the first light-entering surface of the first inner lens with respect to the second light-exiting surface of the second inner lens in the vehicle longitudinal direction, the vehicle width direction, and the vertical direction, in a state where the decorative member to which the first inner lens is attached is attached to the housing to which the second inner lens is attached.

Moreover, in the vehicular lamp fitting described above, the second light guiding unit may extend from the vicinity of the light source to the side opposite to the side where the first inner lens is disposed, and is folded back through a curved portion.

Moreover, in the vehicular lamp fitting described above, the optical axis of the light source may extend in the vehicle width direction of a vehicle on which the vehicular lamp fitting is mounted.

Moreover, in the vehicular lamp fitting described above, the second light guiding unit further may comprise a branched light guiding unit branched from the second light guiding unit; the branched light guiding unit may include a third light-exiting surface and a second reflection surface configured to reflect light guided in the branched light guiding unit to emit light from the third light-exiting surface.

Moreover, in the vehicular lamp fitting described above, the light source may be a light source emitting a luminous flux of 25 lm or more, the vehicular lamp fitting may function as a tail lamp by light emitted from the first light-exiting surface.

According to the present invention, it is possible to provide a vehicular lamp fitting capable of allowing light from a light source to enter a light guiding unit arranged on the front surface side of a decorative member (for example, a reflector) even when the light source is arranged on the back surface side of the decorative member (for example, a reflector) in a state covered with the decorative member.

Further, according to the present invention, the light entering from the light entering portion is branched at the branching point, and the light emitting surface along a plurality of directions is illuminated, so that it is possible to provide a vehicle lamp having multiple functions using one light source.

DESCRIPTION OF EMBODIMENTS

Figure 1A:
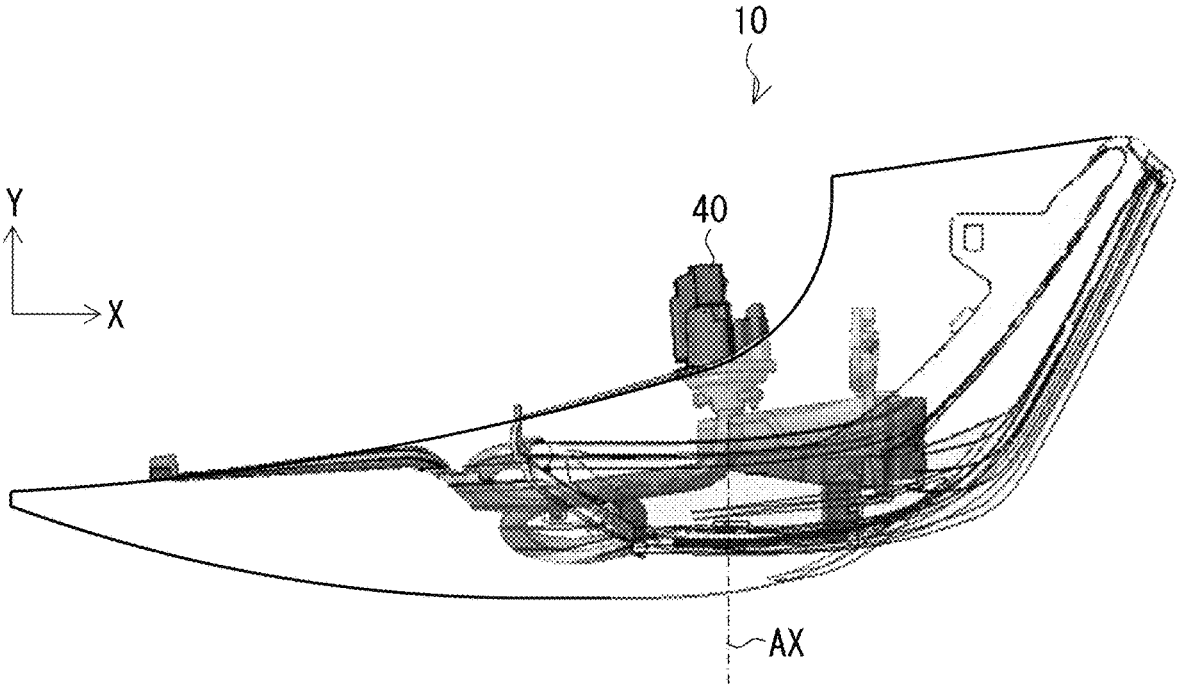
FIG. 1A is a top view (housing 60 omitted) of the vehicular lamp fitting 10.

Hereinafter, a vehicular lamp fitting 10 according to an embodiment of the present disclosure will be described with reference to the appended drawings. In the drawings, corresponding constituent elements are given identical reference characters, and duplicate descriptions thereof will be omitted.

Figure 1B:
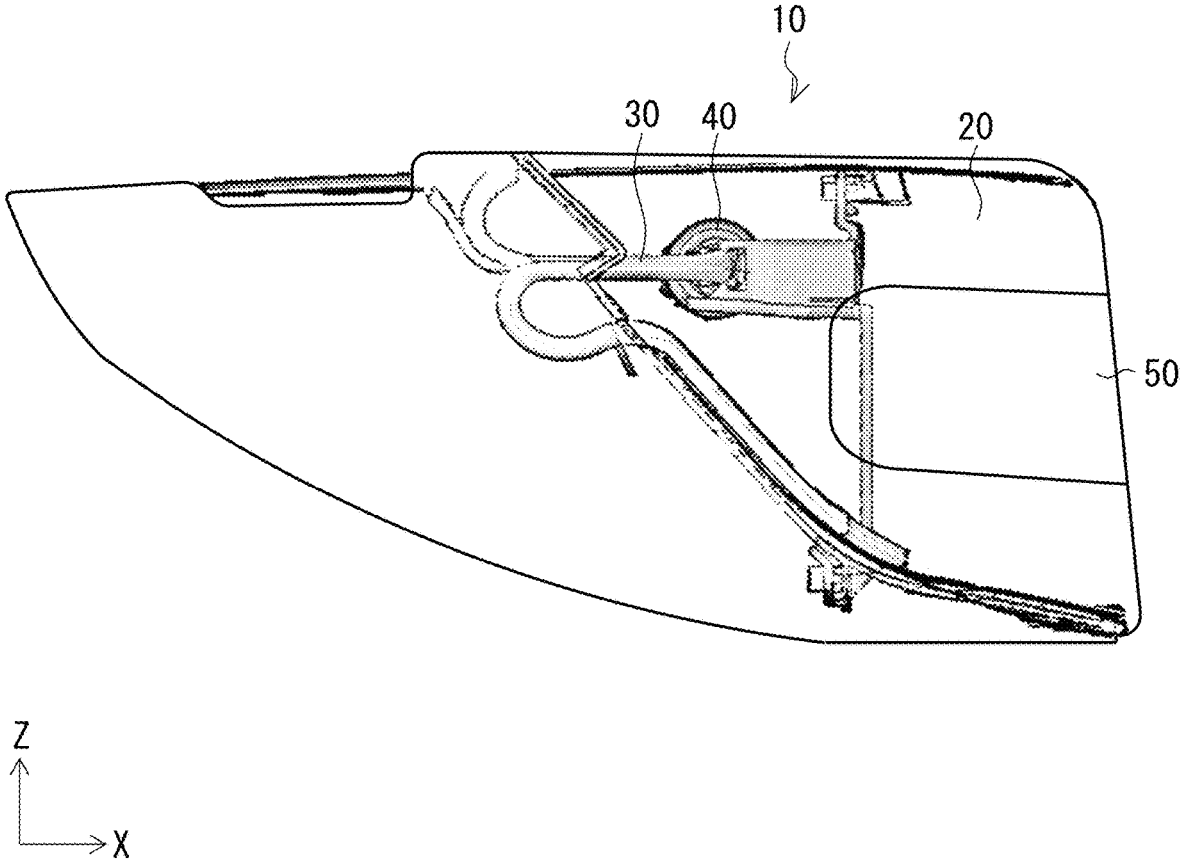
FIG. 1B is a side view (housing 60 omitted) of the vehicular lamp fitting 10.

FIG. 1A is a top view (housing 60 omitted) of the vehicular lamp fitting 10, and FIG. 1B is a side view (housing 60 omitted).

The vehicular lamp fitting 10 is a vehicular signal lamp that functions as a tail lamp and a side marker lamp, and is mounted on both right and left sides of the rear end of a vehicle (not shown) such as an automobile. Since the vehicular lamp fitting 10 mounted on the right and left sides has a symmetrical configuration, the vehicular lamp fitting 10 mounted on the left side (the left side toward the front of the vehicle) of the rear end of the vehicle will be described as a representative. For convenience of explanation, the XYZ axes are defined as shown in FIG. 1. The X-axis extends in the longitudinal direction of the vehicle. The Y-axis extends in the vehicle width direction. The Z-axis extends in the vertical direction.

Figure 2:
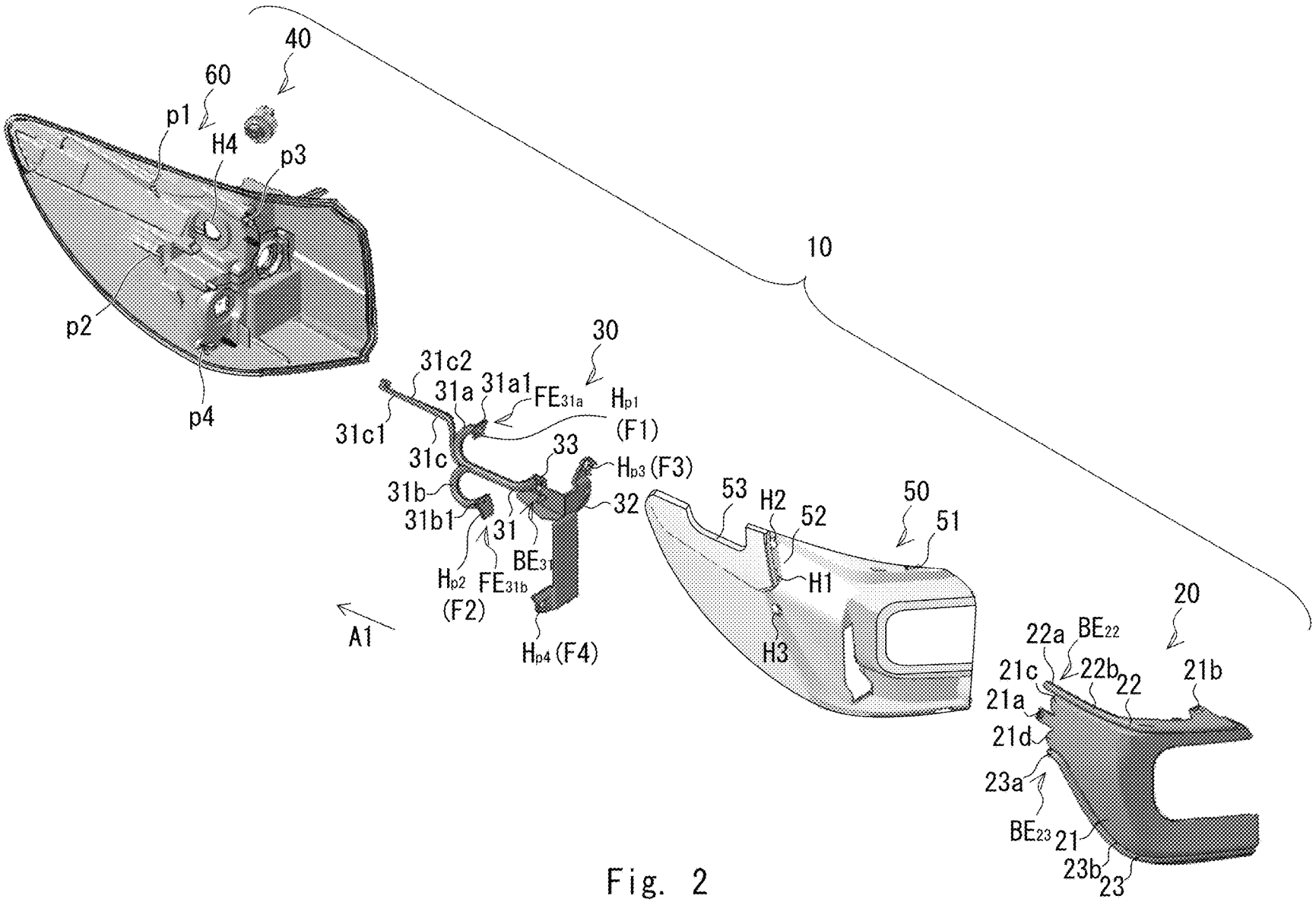
FIG. 2 is an exploded perspective view of the vehicular lamp fitting 10.

FIG. 2 is an exploded perspective view of the vehicular lamp fitting 10.

As shown in FIG. 2, the vehicular lamp fitting 10 includes a first inner lens 20, a second inner lens 30, a light source 40, a reflector 50, and a housing 60. The first inner lens 20 is disposed on the front surface side of the reflector 50. On the other hand, the second inner lens 30, the light source 40, and the housing 60 are disposed on the back surface side of the reflector 50.

The first inner lens 20 is made of a transparent resin such as acrylic or polycarbonate, and as shown in FIG. 2, is provided with a side surface portion 21 disposed on the outside surface (left side surface side) of the vehicle, an upper light guiding unit 22 extending along the upper edge of the side surface portion 21, and a lower light guiding unit 23 extending along the lower edge of the side surface portion 21.

The upper light guiding unit 22 is a rod-shaped light guiding unit having an end surface 22*a* (light-entering surface) on the base end $BE_{22}$ side (vehicle front side). The upper light guiding unit 22 is an example of the first light guiding unit of the present invention. The end surface 22*a* (light-entering surface) on the base end $BE_{22}$ side is, for example, a plane perpendicular to the longitudinal direction (the direction in which the upper light guiding unit 22 extends). An end surface 22*a* (light-entering surface) on the base end $BE_{22}$ side is an example of the first light-entering surface of the present invention. The upper light guiding unit 22 extends from the base end portion $BE_{22}$ substantially toward the rear of the vehicle in the X-direction, and further extends substantially in the Y-direction at the rear end portion of the vehicle through a curved portion.

The outer peripheral surface of the upper light guiding unit 22 includes a light-exiting surface 22*b* (an example of the first light-exiting surface of the present invention) disposed on the front side (the rear side of the vehicle) and a reflection surface (an example of the first reflection surface of the present invention. Not shown in FIG. 2) disposed on the back side opposite to the light-exiting surface. The reflection surface includes a plurality of optical elements (not shown) configured to reflect (diffusely reflect) light guided in the upper light guiding unit 22 and incident on the reflection surface and emitting light from the light-exiting surface 22*b*. The optical element is, for example, a lens cut (e.g., V-groove). The angle of the V-groove is an angle considered so that the light emitted from the light-exiting surface 22*b* satisfies the regulations concerning the tail lamp.

The lower light guiding unit 23 is a rod-shaped light guiding unit having an end surface 23*a* (light-entering surface) on the base end $BE_{23}$ side (vehicle front side). The end surface 23*a* (light-entering surface) on the base end $BE_{23}$ side is, for example, a plane perpendicular to the longitudinal direction (the direction in which the lower light guiding unit 23 extends). The lower light guiding unit 23 extends obliquely downward from the base end portion $BE_{23}$ to the rear side (X direction) of the vehicle, and further extends substantially in the Y-direction at the rear end portion of the vehicle through a curved portion.

The outer peripheral surface of the lower light guiding unit 23 includes a light-exiting surface 23*b* disposed on the front side (the rear side of the vehicle) and a reflection surface (not shown in FIG. 2) disposed on the back side opposite thereto. The reflection surface includes a plurality of optical elements (not shown) configured to reflect (diffusely reflecting) light guided in the lower light guiding unit 23 and incident on the reflection surface to emerge from the light-exiting surface 23*b*. The optical element is, for example, a lens cut (e.g., V-groove). The angle of the V-groove is an angle considered so that the light emitted from the light-exiting surface 23*b* satisfies the regulations concerning the tail lamp.

Figure 3:
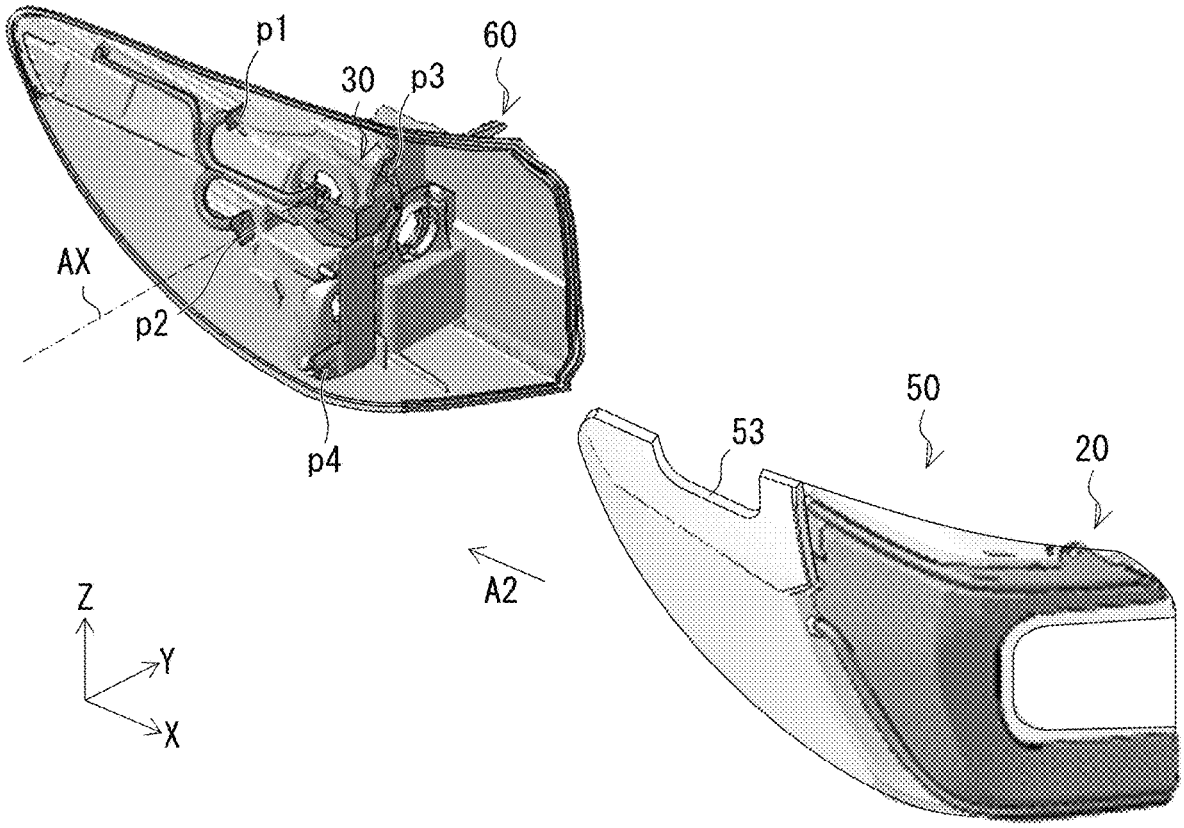
FIG. 3 is a perspective view of a reflector 50 to which a first inner lens 20 is attached and a housing 60 to which a second inner lens 30 is attached.

FIG. 3 is a perspective view of a reflector 50 to which a first inner lens 20 is attached and a housing 60 to which a second inner lens 30 is attached.

As shown in FIG. 3, the first inner lens 20 having the above configuration is attached to the reflector 50 in a state in which its back surface faces the front surface of the reflector 50. The reflector 50 (mainly on the front surface) is mirror-finished by aluminum vapor deposition or the like, and the mirror-finished surface is visible through the first inner lens. Alternatively, the back surface of the first inner lens 20 may be subjected to mirror surface processing such as aluminum vapor deposition.

With the first inner lens 20 attached to the reflector 50, the hook portions 21*a*, 21*b* (see FIG. 2), etc. provided on the first inner lens 20 engage with the reflector 50.

Figure 4:
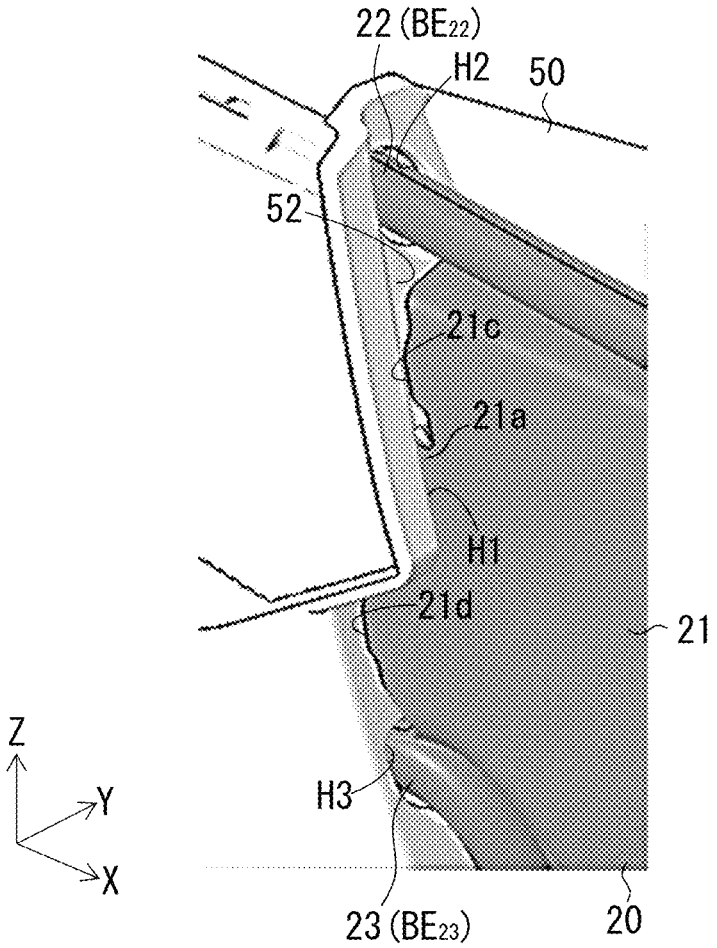
FIG. 4 is an enlarged perspective view of the vicinity of the distal end side of the side surface portion 21.

FIG. 4 is an enlarged perspective view of the vicinity of the distal end side of the side surface portion 21.

For example, as shown in FIG. 4, a hook portion 21*a* (a through-hole formed in the hook portion a) provided on the distal end side of the side surface portion 21 is inserted into a through-hole H1 formed in the reflector 50 and is engaged with an engaging portion (convex part. Not shown) provided on the back surface of the reflector 50. A hook portion 21*b* (a through hole formed in the hook portion) provided in the upper portion of the first inner lens 20 is engaged with an engaging portion 51 (a protrusion) provided in the upper portion of the reflector 50.

Protrusions 21*c* and 21*d* provided on the upper and lower sides of the hook portion 21*a* of the tip portion of the side surface portion 21 abut on the stepped portion 52 of the reflector 50. Thus, the first inner lens 20 is positioned with respect to the reflector 50 in the X direction.

As shown in FIG. 4, the base end $BE_{22}$ side of the upper light guiding unit 22 is inserted into the through hole H2 formed in the reflector 50 (step portion 52 or standing wall). Similarly, the base end $BE_{23}$ side of the lower light guiding unit 23 is inserted into the through hole H3 formed in the reflector 50 (step portion 52 or standing wall). Thus, the first inner lens 20 is positioned with respect to the reflector 50 in the YZ direction.

As described above, the first inner lens 20 is attached to the reflector 50 while being positioned relative to the reflector 50 in the XYZ direction.

The second inner lens 30 is made of a transparent resin such as acrylic or polycarbonate, and includes a light guiding unit 31 and an auxiliary support portion 32 as shown in FIG. 2.

The light guiding unit 31 is a rod-shaped light guiding unit having an end surface 33 (light-entering surface) on the base end $BE_{31}$ side. The light guiding unit 31 (and the first branched light guiding unit 31*a* described later) is an example of the second light guiding unit of the present invention. The end surface 33 (light-entering surface) on the base end $BE_{31}$ side is, for example, a plane perpendicular to the longitudinal direction (the direction in which the light guiding unit 31 extends). The end surface 33 (light-entering surface) on the proximal end $BE_{31}$ side is an example of the second light-entering surface of the present invention. The light guiding unit 31 extends from the base end portion $BE_{31}$ to a side (see arrow A1 in FIG. 2) opposite to the side where the first inner lens 20 is disposed through a curved portion, and branches to the first branch light guiding unit 31*a*, the second branch light guiding unit 31*b*, and the third branch light guiding unit 31*c*.

The first branched light guiding unit 31*a* extends upward through the curved portion and is folded back in a U-shape toward the side where the first inner lens 20 is disposed. An end surface 31*a*1 (light-exiting surface) of the first branch light guiding unit 31*a* on the front end portion $FE_{31a}$ side is, for example, a plane orthogonal to the longitudinal direction (the direction in which the first branch light guiding unit 31*a* extends). An end surface 31*a*1 (light-exiting surface) of the first branched light guiding unit 31*a* on the front end portion $FE_{31a}$ side is an example of the second light-exiting surface of the present invention.

The second branched light guiding unit 31*b* extends downward through the curved portion and is folded back in a U-shape to the side where the first inner lens 20 is disposed. The end surface 31*b*1 (light-exiting surface) of the second branch light guiding unit 31*b* on the side of the distal end portion $FE_{31b}$ is, for example, a plane orthogonal to the longitudinal direction (the direction in which the second branch light guiding unit 31*b* extends).

The third branch light guiding unit 31*c* extends in the X direction toward the front of the vehicle. The outer peripheral surface of the third branch light guiding unit 31*c* includes a light-exiting surface 31*c*1 arranged on the left side surface side of the vehicle and a reflection surface 31*c*2 arranged on the opposite side. The reflection surface 31*c*2 includes a plurality of optical elements (not shown) for reflecting (diffusely reflecting) the light guided in the third branched light guiding unit 31*c* and incident on the reflection surface 31*c*2 and emitting the light from the light-exiting surface 31*c*1. The optical element is, for example, a lens cut (e.g., V-groove). The angle of the V-groove is an angle considered so that the light emitted from the light-exiting surface 31*c*1 satisfies the laws and regulations concerning the side marker lamp.

Figure 8:
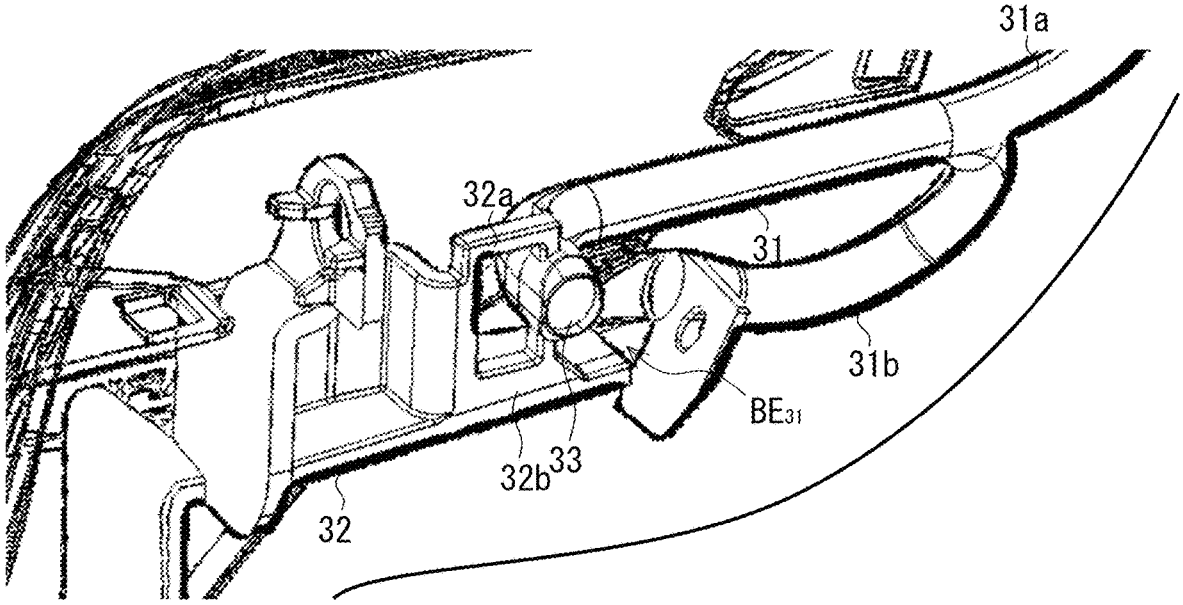
FIG. 8 is a perspective view seen from the direction of arrow A3 in FIG. 2.

FIG. 8 is a perspective view seen from the direction of arrow A3 in FIG. 2.

As shown in FIG. 8, the auxiliary support portion 32 is disposed on the side opposite to the side on which the light guiding unit 31 extends with respect to the end surface 33 (light-entering surface) of the light guiding unit 31. The auxiliary support portion 32 is connected to the base end portion $BE_{31}$ (outer peripheral surface) of the light guiding unit 31 by the arm portions 32*a* and 32*b*. Thus, the auxiliary support portion 32 is integrated with the light guiding unit 31 and constitutes a part of the second inner lens 30. Since the auxiliary support portion 32 is connected to the base end portion $BE_{31}$ (outer peripheral surface) of the light guiding unit 31 by the arm portions 32*a* and 32*b*, the light from the light source 40 entering from the end surface 33 (light entering surface) of the light guiding unit 31 is controlled so as to be guided into the light guiding unit 31, not toward the auxiliary support portion 32. An example of using the auxiliary support portion 32 having a frame-shaped configuration comprising the arm portions 32*a* and 32*b* has been described, but is not limited thereto.

The second inner lens 30 having the above configuration is attached to the housing 60 as shown in FIG. 3.

With the second inner lens 30 attached to the housing 60, positioning pins p1, p2, p3 and p4 (see FIG. 2) provided in the housing 60 are inserted into positioning holes $H_{p1}$, $H_{p2}$, $H_{p3}$ and $H_{p4}$ (see FIG. 2) formed in the second inner lens 30, respectively. Thus, the second inner lens 30 is positioned with respect to the housing 60 in the YZ direction.

The rotation of the second inner lens 30 with respect to the housing 60 is suppressed. The positioning hole $H_{p1}$ is formed in the flange portion F1 provided on the distal end portion $FE_{31a}$ side of the first branch light guiding unit 31*a*. The positioning hole $H_{p2}$ is formed in a flange portion F2 provided on the distal end portion $FE_{31b}$ side of the second branch light guiding unit 31*b*. The positioning holes $H_{p3}$ and $H_{p4}$ are formed in flange portions F3 and F4 provided in the auxiliary support portion 32.

The specific arrangement of the positioning pins p1 to p4 and the positioning holes $H_{p1}$ to $H_{p4}$ will be described.

Figure 9:
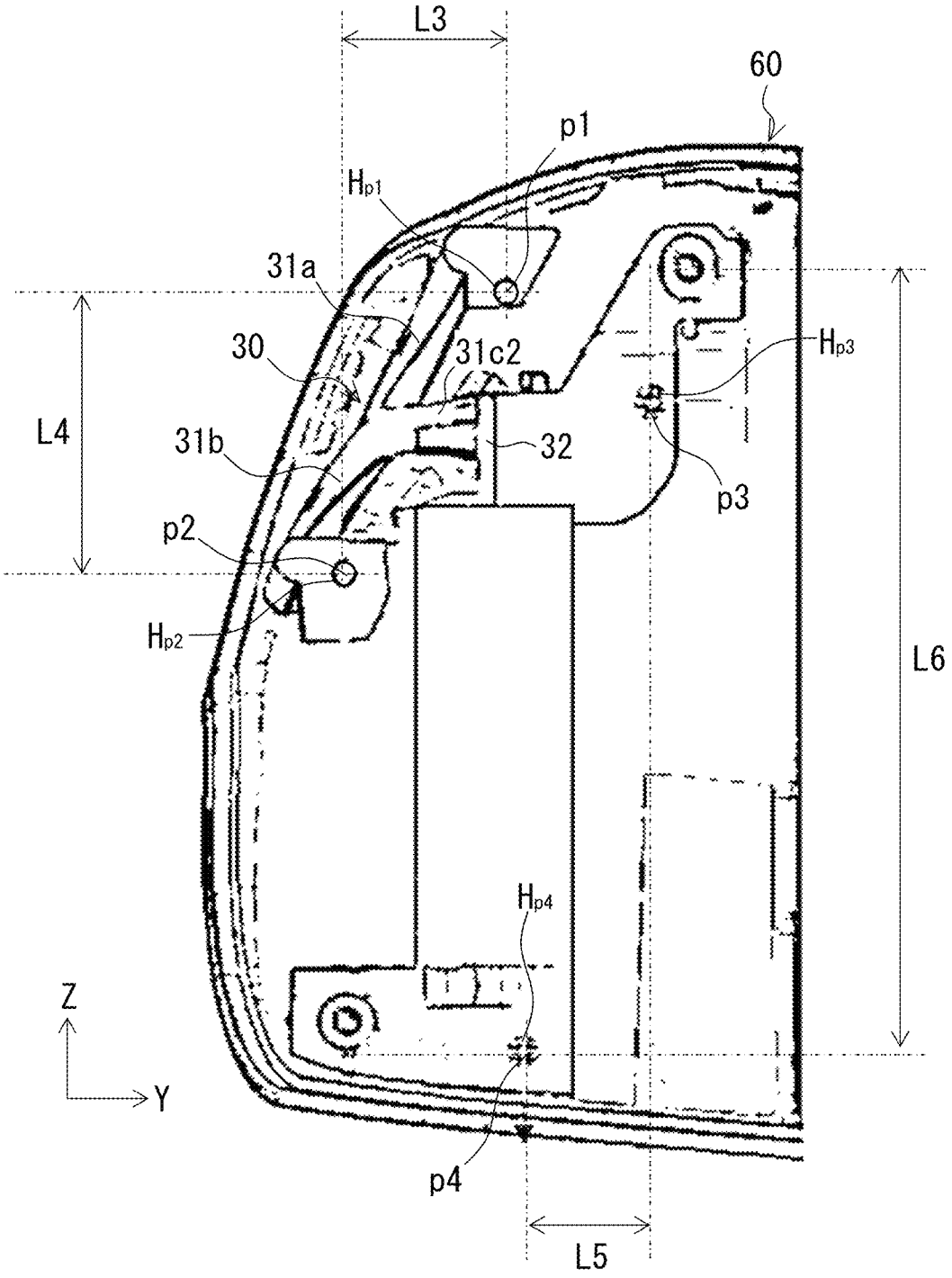
FIG. 9 is an arrow view of the housing 60 to which the second inner lens 30 is attached from the direction of arrow A2 in FIG. 3.

FIG. 9 is an arrow view of the housing 60 to which the second inner lens 30 is attached from the direction of arrow A2 in FIG. 3.

As shown in FIG. 9, the distance between the positioning pin p1 and the positioning pin p2 in the Y direction is L3, and the distance between them in the Z direction is L4 (L4>L3). Similarly, the spacing between the positioning holes $H_{p1}$ and $H_{p2}$ in the Y direction is L3, and the spacing in the Z direction is L4 (L4>L3). The distance between the positioning pin p3 and the positioning pin p4 in the Y direction is L5, and the distance in the Z direction is L6 (L6>L5). Similarly, the spacing between the positioning holes $H_{p3}$ and $H_{p4}$ in the Y direction is L5, and the spacing in the Z direction is L6 (L6>L5). The positioning pin p3 is arranged at substantially the same height as the light source 40 in the Z direction. The positioning pins p3 and p4 are arranged on the same plane (a plane parallel to the YZ plane). The positioning pins p3 and p4 are arranged on both sides of the end surface 33 (light-entering surface) of the light guiding unit 31 in the Y direction. Regarding the number and position of the positioning pins and the positioning holes, although an example using the positioning pins p1 to p4 and the positioning holes $H_{p1}$ to $H_{p4}$ has been described, it is not limited thereto. By the engagement of the positioning pin and the positioning hole, it is possible to prevent the second inner lens 30 (second light-entering surface) from rotating relative to the light source. Thus, the distance between the second light-entering surface and the light source can be secured.

Figure 6:
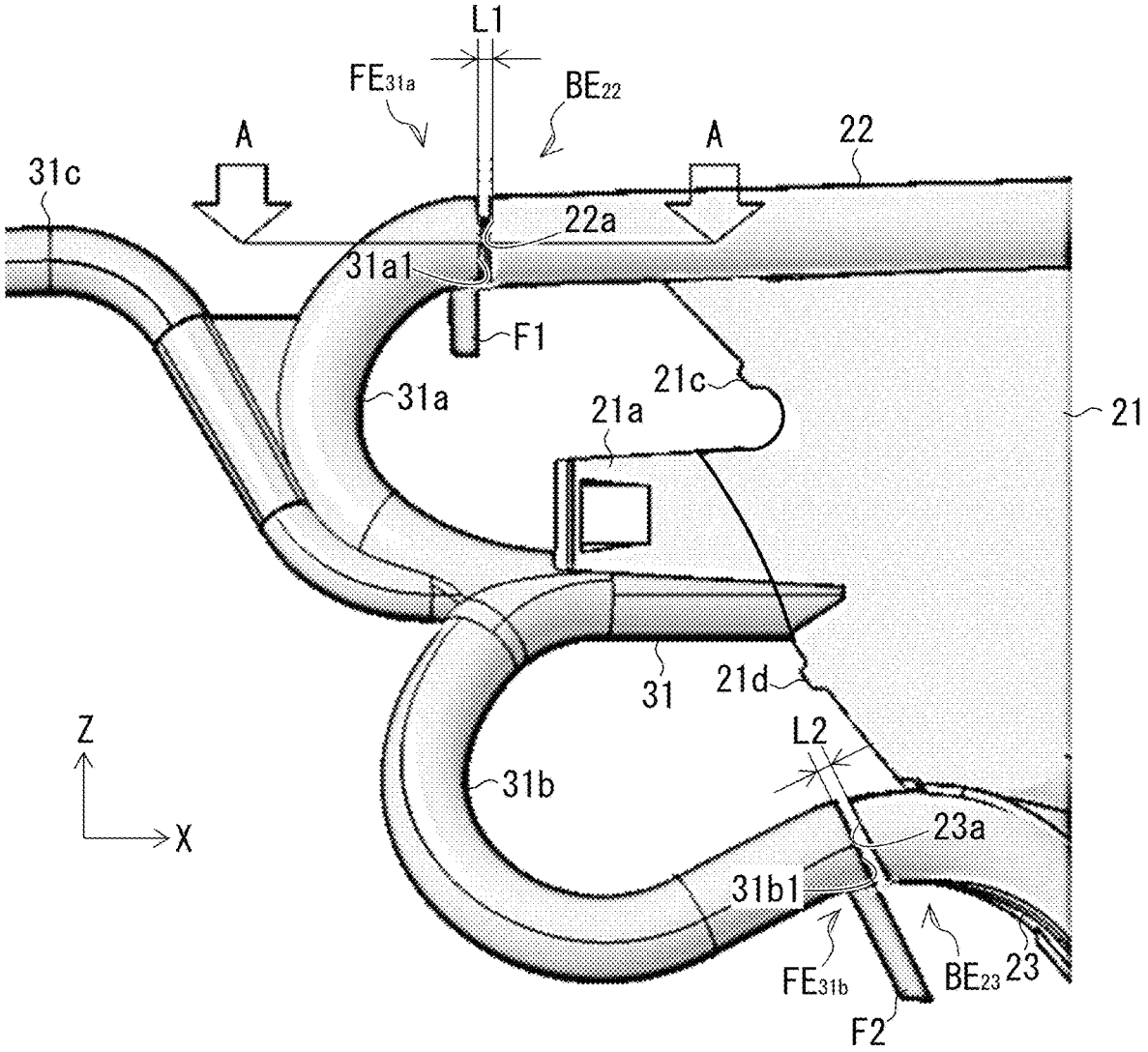
FIG. 6 is an enlarged side view of the vicinity of an end surface 22*a* (light-entering surface) of the base end $BE_{22}$ side of the upper light guiding unit 22 of the first inner lens 20 and an end surface 31*a*1 (light-exiting surface) of the tip end $FE_{31a}$ side of the first branched light guiding unit 31*a* of the second inner lens 30.
Figure 7A:
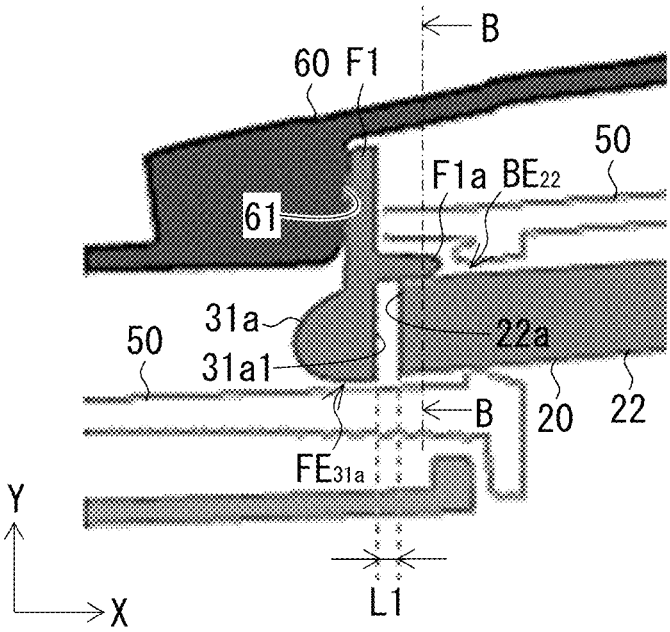
FIG. 7A is a sectional view taken along line A-A of FIG. 6.

The flange portion F1 provided on the front end portion $FE_{31a}$ side of the first branch light guiding unit 31*a* abuts on the housing 60 (step portion 61) (see FIG. 7(A)). FIG. 7A is a sectional view taken along line A-A of FIG. 6. Similarly, although not shown, the flange portions F2 to F4 abut against the housing 60. Thus, the second inner lens 30 is positioned with respect to the housing 60 in the X direction.

As described above, the second inner lens 30 is attached to the housing 60 in a state of being positioned relative to the housing 60 in the XYZ direction.

Figure 5:
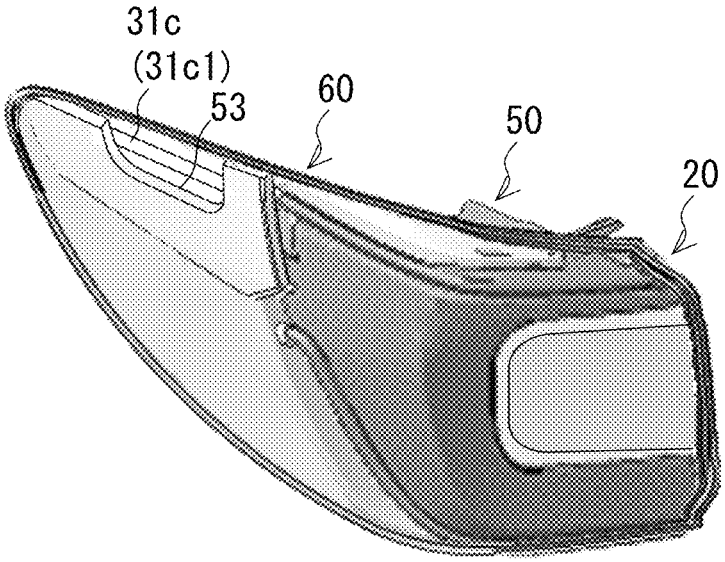
FIG. 5 is a perspective view of the housing 60 to which the reflector 50 is attached.

FIG. 5 is a perspective view of the housing 60 to which the reflector 50 is attached.

As shown in FIG. 5, the reflector 50 to which the first inner lens 20 is attached is attached to the housing 60 to which the second inner lens 30 is attached. With the reflector 50 attached to the housing 60, the third branched light guiding unit 31*c* (light-exiting surface 31*c*1) of the second inner lens 30 is exposed from the notch portion 53 provided in the reflector 50 (see FIG. 5).

Next, an example of a positioning structure in which an end surface 22*a* (light incoming surface) on the base end $BE_{22}$ side of the upper light guiding unit 22 of the first inner lens 20 is positioned with respect to an end surface 31*a*1 (light outgoing surface) on the tip end $FE_{31a}$ side of the first branch light guiding unit 31*a* of the second inner lens 30 in the vehicle longitudinal direction (X direction), the vehicle width direction (Y direction), and the vertical direction (Z direction) will be described.

With the reflector 50 attached to the housing 60, as shown in FIG. 7A, the reflector 50 (tip portion) comes into contact with a flange portion F1 provided on the tip portion $FE_{31a}$ side of the first branch light guiding unit 31*a*, and presses the flange portion F1 against the housing 60 (step portion 61). As a result, the end surface 22*a* (light-entering surface) on the base end $BE_{22}$ side of the upper light guiding unit 22 of the first inner lens 20 is positioned with respect to the end surface 31*a*1 (light-exiting surface) on the tip end $FE_{31a}$ side of the first branch light guiding unit 31*a* of the second inner lens 30 in the X direction.

Specifically, the proximal end $BE_{22}$ side of the upper light guiding unit 22 of the first inner lens 20 is shorter in the X direction than the distal end portion of the reflector 50 (distance L1 short. See FIG. 7A). The distance L1 is, for example, 1 mm. Therefore, with the distal end of the reflector 50 in contact with the flange portion F1, the end face 22*a* (light-entering surface) on the proximal end $BE_{22}$ side of the upper light guiding unit 22 of the first inner lens 20 is positioned with a space corresponding to the distance L1 maintained between the end face 31*a*1 (light-exiting surface) on the distal end $FE_{31a}$ side of the first branch light guiding unit 31*a* of the second inner lens 30 in the X direction (see FIG. 6). FIG. 6 is an enlarged side view of the vicinity of an end surface 22*a* (light-entering surface) of the base end $BE_{22}$ side of the upper light guiding unit 22 of the first inner lens 20 and an end surface 31*a*1 (light-exiting surface) of the tip end $FE_{31a}$ side of the first branched light guiding unit 31*a* of the second inner lens 30.

Similarly, although not shown, the proximal end $BE_{23}$ side of the lower light guiding unit 23 of the second inner lens 20 is shorter in the X direction than the distal end portion of the reflector 50 (the distance L2 is shorter). The distance L2 is, for example, 1 mm. Therefore, with the distal end of the reflector 50 in contact with the flange portion F2 provided on the distal end $FE_{31b}$ side of the second branched light guiding unit 31*b* of the second inner lens 30, the end face 23*a* (light-entering surface) on the proximal end $BE_{23}$ side of the lower light guiding unit 23 of the first inner lens 20 is positioned with a space corresponding to the distance L2 maintained between the end face 31*b*1 (light-exiting surface) on the distal end $FE_{31b}$ side of the second branched light guiding unit 31*b* of the second inner lens 30 in the X direction (see FIG. 6).

Figure 7B:
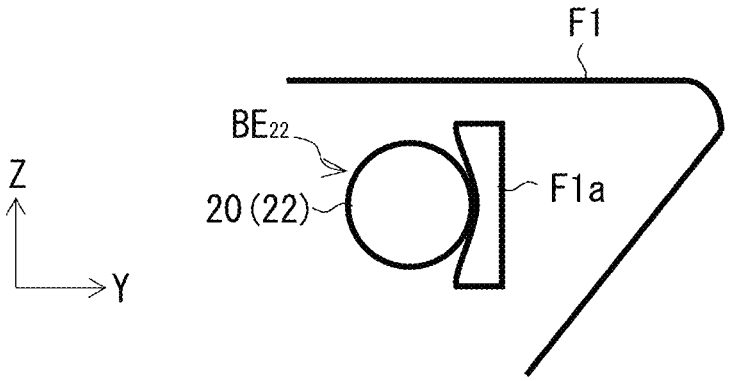
FIG. 7B is a cross-sectional view of FIG. 7A, B-B.

With the reflector 50 attached to the housing 60, as shown in FIG. 7B, the base end $BE_{22}$ side (outer peripheral surface) of the upper light guiding unit 22 of the first inner lens 20 comes into contact with the stopper portion Fla provided on the tip end $FE_{31a}$ side (flange portion F1) of the first branch light guiding unit 31*a* of the second inner lens 30. FIG. 7B is a cross-sectional view of FIG. 7A, B-B. The cross section of the stopper portion Fla is concave. Therefore, the base end $BE_{22}$ side (outer peripheral surface) of the upper light guiding unit 22 of the first inner lens 20 abutting on the stopper portion Fla is guided to the bottom portion of the concave shape along the stopper portion Fla (concave shape).

As a result, the end surface 22*a* (light-entering surface) on the base end $BE_{22}$ side of the upper light guiding unit 22 of the first inner lens 20 is positioned with respect to the end surface 31*a*1 (light-exiting surface) on the tip end $FE_{31a}$ side of the first branch light guiding unit 31*a* of the second inner lens 30 in the YZ direction.

Similarly, although not shown, the end surface 23*a* (light-entering surface) on the base end $BE_{23}$ side of the lower light guiding unit 23 of the first inner lens 20 is positioned with respect to the end surface 31*b*1 (light-exiting surface) on the tip end $FE_{31b}$ side of the second branch light guiding unit 31*b* of the second inner lens 30 in the YZ direction.

By positioning as described above, the central axis (optical axis) of the end face 22*a* (light-entering surface) on the base end $BE_{22}$ side of the upper light guiding unit 22 of the first inner lens 20 and the central axis (optical axis) of the end face 31*a*1 (light-exiting surface) on the tip end $FE_{31a}$ side of the first branch light guiding unit 31*a* of the second inner lens 30 are substantially coincident. Thereby, the light emitted from the end face 31*a*1 (light-exiting surface) on the side of the distal end $FE_{31a}$ of the first branched light guiding unit 31*a* of the second inner lens 30 can efficiently enter the end face 22*a* (light-entering surface) on the side of the proximal end $BE_{22}$ of the upper light guiding unit 22 of the first inner lens 20.

Similarly, the central axis (optical axis) of the end face 23*a* (light-entering surface) on the base end $BE_{23}$ side of the lower light guiding unit 23 of the first inner lens 20 and the central axis (optical axis) of the end face 31*b*1 (light-exiting surface) on the tip end $FE_{31b}$ side of the second branch light guiding unit 31*b* of the second inner lens 30 are substantially coincident. As a result, the light emitted from the end face 31*b*1 (light-exiting surface) on the side of the distal end $FE_{31b}$ of the second branched light guiding unit 31*b* of the second inner lens 30 can efficiently enter the end face 23*a* (light-entering surface) on the side of the proximal end $BE_{23}$ of the lower light guiding unit 23 of the first inner lens 20.

As described above, the reflector 50 is attached to the housing 60 in a state in which the end face 22*a* of the upper light guiding unit 22 of the first inner lens 20 on the base end $BE_{22}$ side (light-entering surface) is positioned with respect to the end face 31*a*1 (light-exiting surface) on the distal end $FE_{31a}$ a side of the first branched light guiding unit 31*a* of the second inner lens 30 in the XYZ direction, and the end face 23*a* of the lower light guiding unit 23 of the first inner lens 20 on the base end $BE_{23}$ side (light-exiting surface) is positioned with respect to the end face 31*b*1 (light-exiting surface) on the distal end $FE_{31b}$ side of the second branched light guiding unit 31*b* of the second inner lens 30 in the XYZ direction.

The light source 40 is a socket type light source and includes a semiconductor light emitting element such as at least one LED emitting red light. The light source 40 is a light source which emits a luminous flux (a luminous flux of 25 lm or more) larger than a luminous flux (about 20 lm) emitted from a light source generally used for a tail lamp. Thereby, even if light loss occurs in the curved portion or the like of the second inner lens 30, laws and regulations concerning the tail lamp and the side marker lamp can be satisfied.

The light source 40 is inserted into a through hole H4 (see FIG. 2) formed in the housing 60, and is attached to the housing 60 in a state (a state directed to the left side of the vehicle) in which the light emitting portion thereof faces the end surface 33 (light-entering surface) of the base end $BE_{31}$ side of the light guiding unit 31 of the second inner lens 30. The optical axis AX (see FIG. 1A, FIG. 3) of the light source 40 extends generally in the vehicle width direction (Y direction).

The reflector 50 is a decorative member in which mirror surface processing such as aluminum vapor deposition is applied to at least one of a front surface side and a back surface side.

In the vehicular lamp fitting 10 having the above configuration, the light distribution pattern for the tail lamp and the light distribution pattern for the side marker lamp can be formed by lighting the light source 40.

When the light source 40 is turned on, light from the light source 40 enters the light guiding unit 31 from the end face 33 (light-entering surface) on the base end $BE_{31}$ side of the light guiding unit 31 of the second inner lens 30, and is guided in the light guiding unit 31 while repeating inner surface reflection (total reflection) in the light guiding unit 31. The light from the light source 40 guided in the light guiding unit 31 enters the first branch light guiding unit 31*a*, the second branch light guiding unit 31*b*, and the third branch light guiding unit 31*c*.

The light from the light source 40 entering the first branched light guiding unit 31*a* is guided in the first branched light guiding unit 31*a* while repeating inner surface reflection (total reflection) in the first branched light guiding unit 31*a*, is emitted from the end face 31*a*1 (light exit surface) on the side of the tip portion $FE_{31a}$ of the first branched light guiding unit 31*a*, enters the upper light guiding unit 22 from the end face 22*a* (light-entering surface) on the side of the base end $BE_{22}$ of the upper light guiding unit 22 of the first inner lens 20, and is guided in the upper light guiding unit 22 while repeating inner surface reflection (total reflection) in the upper light guiding unit 22. The light from the light source 40 guided in the upper light guiding unit 22 is internally reflected (diffusely reflected) by the reflection surface (optical element) and exits from the light exit surface 22*b* of the upper light guiding unit 22.

Similarly, light from the light source 40 entering the second branched light guiding unit 31*b* is guided in the second branched light guiding unit 31*b* while repeating inner surface reflection (total reflection) in the second branched light guiding unit 31*b*, emerges from the end surface 31*b*1 (light exit surface) on the distal end $FE_{31b}$ side of the second branched light guiding unit 31*b*, enters the lower light guiding unit 23 from the end surface 23*a* (light entry surface) on the proximal end $BE_{23}$ side of the lower light guiding unit 23 of the first inner lens 20, and is guided in the lower light guiding unit 23 while repeating inner surface reflection (total reflection) in the lower light guiding unit 23. The light from the light source 40 guided in the lower light guiding unit 23 is internally reflected (diffusely reflected) by the reflection surface (optical element) and exits from the light exit surface 23*b* of the lower light guiding unit 23.

As described above, the light distribution pattern for the tail lamp is realized by the light emitted from the light-exiting surface 22*b* of the upper light guiding unit 22 and the light emitted from the light-exiting surface 23*b* of the lower light guiding unit 23.

On the other hand, the light from the light source 40 entering the third branch light guiding unit 31*c* is guided in the third branch light guiding unit 31*c* while repeating inner surface reflection (total reflection) in the third branch light guiding unit 31*c*. The light from the light source 40 guided in the third branched light guiding unit 31*c* is internally reflected (diffusely reflected) by the reflection surface 31*c*2 (optical element) and exits from the light exit surface 31*c*1 of the third branched light guiding unit 31*c*.

As described above, a light distribution pattern for a side marker lamp is realized by light emitted from the light-exiting surface 31*c*1 of the third branched light guiding unit 31*c*.

As described above, according to the present embodiment, even when the light source 40 is disposed on the back surface side of the reflector 50 in a state covered with the reflector 50, light from the light source 40 can enter the first inner lens 20 (upper light guiding unit 22, lower light guiding unit 23) disposed on the front surface side of the reflector 50.

This is because of the following reasons. The first reason is that the first inner lens 20 and the second inner lens 30 are separated from each other. The second reason is that the end face 22*a* (light-entering surface) on the base end $BE_{22}$ side of the upper light guiding unit 22 of the first inner lens 20 and the end face 31*a*1 (light-exiting surface) on the tip end $FE_{31a}$ side of the first branched light guiding unit 31*a* of the second inner lens 30 are arranged so as to face each other across a space. The third reason is that the end surface 23*a* (light incoming surface) on the base end $BE_{23}$ side of the lower light guiding unit 23 of the first inner lens 20 and the end surface 31*b*1 (light outgoing surface) on the tip end $FE_{31b}$ side of the second branched light guiding unit 31*b* of the second inner lens 30 are disposed so as to face each other across a space.

According to the present embodiment, the space between the end face 22*a* (light-entering surface) on the base end $BE_{22}$ side of the upper light guiding unit 22 of the first inner lens 20 and the end face 31*a*1 (light-exiting surface) on the tip end $FE_{31a}$ side of the first branch light guiding unit 31*a* of the second inner lens 30 can be covered with the reflector 50 so as not to be visually recognized from the outside.

This is because of the following reasons. The first reason is that the base end $BE_{22}$ side of the upper light guiding unit 22 of the first inner lens 20 is inserted into the through hole H2 formed in the reflector 50. The second reason is that the end face 22*a* (light-entering surface) on the base end $BE_{22}$ side of the upper light guiding unit 22 of the first inner lens 20 and the end face 31*a*1 (light-exiting surface) on the tip end $FE_{31a}$ side of the first branched light guiding unit 31*a* of the second inner lens 30 are opposed to each other across a space on the back surface side of the reflector 50.

Similarly, the space between the end face 23*a* (light-entering surface) on the base end $BE_{23}$ side of the lower light guiding unit 23 of the first inner lens 20 and the end face 31*b*1 (light-exiting surface) on the tip end $FE_{31b}$ side of the second branch light guiding unit 31*b* of the second inner lens 30 can be covered with the reflector 50 so as not to be visually recognized from the outside.

This is because of the following reasons. The first reason is that the base end $BE_{23}$ side of the lower light guiding unit 23 of the first inner lens 20 is inserted into the through hole H3 formed in the reflector 50. The second reason is that the end face 23*a* (light-entering surface) on the base end $BE_{23}$ side of the lower light guiding unit 23 of the first inner lens 20 and the end face 31*b*1 (light-exiting surface) on the tip end $FE_{31b}$ side of the second branched light guiding unit 31*b* of the second inner lens 30 are opposed to each other across a space on the back surface side of the reflector 50.

Further, according to the present embodiment, since the positioning structure is provided, by attaching the reflector 50 to which the first inner lens 20 is attached to the housing 60 to which the second inner lens 30 is attached, the end face 22*a* (light-entering surface) on the base end $BE_{22}$ side of the upper light guiding unit 22 of the first inner lens 20 can be positioned with respect to the end face 31*a*1 (light-exiting surface) on the tip end $FE_{31a}$ side of the first branch light guiding unit 31*a* of the second inner lens 30 in the XYZ direction. Thereby, the light emitted from the end face 31*a*1 (light-exiting surface) on the side of the distal end $FE_{31a}$ of the first branched light guiding unit 31*a* of the second inner lens 30 can efficiently enter the end face 22*a* (light-entering surface) on the side of the proximal end $BE_{22}$ of the upper light guiding unit 22 of the first inner lens 20.

Similarly, by attaching the reflector 50 to which the first inner lens 20 is attached to the housing 60 to which the second inner lens 30 is attached, the end surface 23*a* (light incoming surface) on the base end $BE_{23}$ side of the lower light guiding unit 23 of the first inner lens 20 can be positioned with respect to the end surface 31*b*1 (light outgoing surface) on the tip end $FE_{31b}$ side of the second branch light guiding unit 31*b* of the second inner lens 30 in the XYZ direction. As a result, the light emitted from the end face 31*b*1 (light-exiting surface) on the side of the distal end $FE_{31b}$ of the second branched light guiding unit 31*b* of the second inner lens 30 can efficiently enter the end face 23*a* (light-entering surface) on the side of the proximal end $BE_{23}$ of the lower light guiding unit 23 of the first inner lens 20.

Next, a modified example will be described.

In the above embodiment, an example in which two light guiding units of the upper light guiding unit 22 and the lower light guiding unit 23 are used has been described, but the present invention is not limited thereto. For example, the upper light guiding unit 22 or the lower light guiding unit 23 may be omitted. Three or more light guiding units may be used.

Further, in the above embodiment, an example in which three branched light guiding units of the first branched light guiding unit 31*a*, the second branched light guiding unit 31*b*, and the third branched light guiding unit 31*c* are used has been described, but is not limited thereto. For example, one, two, or four or more branch light guiding units may be used.

Further, in the above embodiment, an example has been described in which an upper light guiding unit 22 extending in the X direction from the base end portion $BE_{22}$ generally toward the rear of the vehicle and extending in the Y direction generally by turning around to the rear end portion of the vehicle via a curved portion, and a lower light guiding unit 22 extending obliquely downward from the base end portion $BE_{23}$ generally toward the rear end portion of the vehicle (in the X direction) generally by turning around to the rear end portion of the vehicle via a curved portion and extending in the Y direction generally. That is, various forms of light guiding units may be used depending on the vehicle design and the lamp design.

In the above embodiment, an example in which the vehicular lamp fitting of the present invention is applied to a tail lamp and a side marker lamp has been described, but the present invention is not limited thereto. For example, the vehicular lamp fitting of the present invention may be applied to other vehicular signal lamps such as position lamps, front combination lamps, rear combination lamps, position lamps, etc.

The numerical values indicated in the foregoing embodiment are all examples, and it is needless to say that any other numerical values different from those stated above can also be used.

In any and all respect, the foregoing embodiment is merely an example. The present disclosure should not be construed as limiting based on the description of the foregoing embodiment. The present disclosure can be embodied in various other forms without departing from the spirit and the pertinent features of the present disclosure.

What is claimed is:

1. A vehicular lamp fitting comprising:

a decorative member;

a first inner lens disposed on the front surface side of the decorative member;

a light source disposed on the back surface side of the decorative member;

a second inner lens disposed on the back surface side of the decorative member; and a housing; wherein the first inner lens includes a first light-entering surface, a first light-exiting surface, a first light guiding unit configured to guide light entering from the first light-entering surface, and a first reflection surface configured to reflect the light guided in the first light guiding unit to exit from the first light-exiting surface;

the second inner lens includes a second light-entering surface arranged in a state facing the light source, a second light-exiting surface arranged in a state facing the first light-entering surface through a space, and a second light guiding unit configured to guide light from the light source, which has entered from the second light-entering surface, to the second light-exiting surface;

the first inner lens is attached to the decorative member, the second inner lens is attached to the housing, the second inner lens includes a flange portion with which the decorative member comes into contact and which is pressed against the housing, in a state where the decorative member is attached to the housing and a stopper portion with which an outer peripheral surface of the first light-entering surface side of the first inner lens comes into contact, in a state where the decorative member is attached to the housing, the first light-entering surface of the first inner lens is positioned with respect to the second light-exiting surface of the second inner lens so as to maintain a predetermined distance between the first light-entering surface and the second light-exiting surface of the second inner lens, when the decorative member comes into contact with the flange portion and the flange portion is pressed against the housing, the first light-entering surface of the first inner lens is positioned with respect to the second light-exiting surface of the second inner lens so that the optical axis of the first inner lens coincides with the optical axis of the second inner lens, when the outer peripheral surface of the first light-entering surface side of the first inner lens comes into contact with the stopper portion.

2. The vehicular lamp fitting according to claim 1, wherein the decorative member is formed with a through hole passing through its front surface and its back surface, the first light-entering surface side of the first light guiding unit is inserted into the through hole, the first light-entering surface of the first inner lens and the second light-exiting surface of the second inner lens are opposed to each other through a space on the back surface side of the decorative member so that light exiting from the second light-exiting surface enters from the first light-entering surface.

3. The vehicular lamp fitting according to claim 1, wherein a cross section of the stopper portion has a concave shape, the outer peripheral surface of the first light-entering surface side of the first inner lens is guided to the bottom portion of the concave shape along the concave shape.

4. The vehicular lamp fitting according to claim 1, wherein the second light guiding unit extends from the vicinity of the light source to the side opposite to the side where the first inner lens is disposed, and is folded back through a curved portion.

5. The vehicular lamp fitting according to claim 1, wherein the optical axis of the light source extends in the vehicle width direction of a vehicle on which the vehicular lamp fitting is mounted.

6. The vehicular lamp fitting according to claim 1, wherein the second light guiding unit further comprises a branched light guiding unit branched from the second light guiding unit;

the branched light guiding unit includes a third light-exiting surface and a second reflection surface configured to reflect light guided in the branched light guiding unit to emit light from the third light-exiting surface.

7. The vehicular lamp fitting according to claim 1, wherein the light source is a light source emitting a luminous flux of 25 lm or more, the vehicular lamp fitting functions as a tail lamp by light emitted from the first light-exiting surface.

* * * * *